US005481839A

United States Patent [19]

Lang et al.

[11] Patent Number: 5,481,839

[45] Date of Patent: Jan. 9, 1996

[54] GLAZED PANEL WALL CONSTRUCTION AND METHOD FOR ASSEMBLY THEREOF

[75] Inventors: William J. Lang, Alpharetta, Ga.; Phillip E. Garling, Rogers, Ariz.

[73] Assignee: Kawneer Company, Inc., Norcross, Ga.

[21] Appl. No.: 942,589

[22] Filed: Sep. 9, 1992

[51] Int. Cl.[6] ..... E04B 2/62

[52] U.S. Cl. ..... 52/235; 52/461; 52/489.1; 52/780

[58] Field of Search ..... 52/235, 461, 465, 52/777, 780, 204.5, 489.1, 730.1, 730.3

[56] References Cited

U.S. PATENT DOCUMENTS

| | | | |
|---|---|---|---|
| 2,014,419 | 9/1935 | Voigt | 52/461 |
| 3,527,011 | 9/1970 | Bloom et al. . | |
| 4,008,552 | 2/1977 | Biebuyck . | |
| 4,117,640 | 10/1978 | Vanderstar . | |
| 4,428,171 | 1/1984 | Harbin . | |

OTHER PUBLICATIONS

1600 Wall, Kawneer Company, Inc., Norcross, Ga., pp. 1, 2, 12, & 13 (1987).

Temporary Dutchman Clip 1500 CS/BV/ST, Kawneer Company, Inc., Norcross, Ga. (Dec. 2, 1988).

NuCoRE Framing System, Kawneer Company, Inc., Norcross, Ga. (1987).

*Primary Examiner*—Carl D. Friedman
*Assistant Examiner*—Kien T. Nguyen
*Attorney, Agent, or Firm*—Jones & Askew

[57] ABSTRACT

A temporary glazing panel retainer is disclosed for use in a glazed panel wall construction. The glazing panel retainer engages a glazing clip mounted onto the face of a frame member to maintain glazing panels within their respective glazing recesses on either side of the frame member during assembly of the wall construction. The retainer is configured to be concealed beneath a cover member such that the retainer does not have to be removed to install the cover member.

5 Claims, 8 Drawing Sheets

GLAZED PANEL WALL CONSTRUCTION AND METHOD FOR ASSEMBLY THEREOF

TECHNICAL FIELD

The present invention relates generally to glazed panel wall constructions, such as curtain walls, storefronts, and the like. More specifically, the present invention relates to a temporary retainer for engaging the edges of glazing panels to retain the panels within their respective glazing recesses during assembly of the glazed panel wall.

BACKGROUND OF THE INVENTION

Storefront and curtain wall constructions are known which employ a snap-on cover member to maintain glazing panels in place. Such wall constructions typically comprise a frame member having a channel formed on its front face and glazing recesses defined on either side thereof. A glazing clip, usually comprised of a thermally insulating material, engages the channel in the front face of the frame member and projects outwardly therefrom. The snap-on cover member includes an inwardly projecting flange which couples to the glazing clip to fasten the cover member to the frame member. Glazing gaskets disposed along the rear edges of the cover member engage marginal portions of the outer surface of the corresponding glazing panels to maintain the glazing panels in place within their respective glazing recesses.

While such wall constructions are generally easy to erect, there exists a problem during assembly with respect to how to retain the glazing panels in place prior to installation of the snap-on cover member. Since a number of glazing panels are typically placed in position before the snap-on cover members are installed, a means must be provided to temporarily retain the glazing panels within their respective glazing recesses until such time as it is appropriate to install the cover members.

Prior art construction procedures generally call for pressure plates to be screwed into the front face of the frame member at spaced intervals to maintain the glazing panels in place prior to the cover members being installed. However, this procedure suffers certain disadvantages. First, the step of attaching the pressure plates to the frame members is time consuming, as it requires driving a screw through the pressure plate and into the face of the frame member. Further, when it is time to mount the cover members, the pressure plates must be removed.

Thus, there is a need for an apparatus and method for temporarily retaining glazing panels within their respective glazing pockets until such time as it is appropriate to install the cover members which does not require screwing a pressure plate into the front face of the underlying framing member.

There is a further need for an apparatus and method temporarily retaining glazing panels which does not require the step of removing the retaining apparatus prior to installing the snap-on cover member.

SUMMARY OF THE INVENTION

As will be seen, the present invention overcomes these and other difficulties associated with prior art glazed panel wall constructions. Stated generally, the present invention comprises an improved apparatus and method for temporarily retaining glazing panels within their respective glazing pockets until such time as it is appropriate to install the cover members. The apparatus and method of the present invention does not require screwing a pressure plate into the front face of the underlying framing member. Further, the glazing panels are retained in such a manner that the retainer apparatus need not be removed prior to the installation of the cover member, thereby eliminating a step in the erection process.

Stated somewhat more specifically, in a first aspect the present invention pertains to a glazed panel wall construction. A frame member has a channel formed in its outer face and has glazing recesses formed on either side thereof. A glazing clip engages the channel in the outer face of the frame member and projects forwardly therefrom. A pair of glazing panels each have an edge disposed within a corresponding one of the glazing recesses. A glazing panel retainer engages the glazing clip and has bearing surfaces which engage a mutually facing marginal portion of the outer surface of each of the glazing panels to retain the glazing panels within the glazing recesses during assembly of the curtain wall construction. A cover member engages the glazing clip, the cover member comprising means for retaining the glazing panels within the glazing recesses. When the cover member is installed, the glazing panel retainer is concealed beneath the cover member such that the glazing panel retainer does not have to be disengaged from the glazing clip prior to the cover member being engaged with the glazing clip.

In a disclosed embodiment, the glazing clip comprises an outer portion and an inner portion narrower than the outer portion. The glazing panel retainer has a keyhole-shaped aperture formed therein. The keyhole-shaped aperture has a first portion whose width is wider than the inner portion of the glazing clip but narrower than the outer portion of the glazing clip. The keyhole-shaped aperture has a second portion whose width is greater than the outer portion of the glazing clip. To engage the retainer with the glazing clip, the second portion of the keyhole-shaped aperture is advanced over the outer portion of the glazing clip. When the retainer has been advanced beyond the outer portion of the glazing clip, the first portion of the keyhole-shaped aperture is advanced over the inner portion of the glazing clip and beneath the outer portion of the glazing clip.

In another aspect, the present invention comprises a glazing panel retainer for use with a glazed panel wall construction which includes a frame member having a channel formed in its outer face and having glazing recesses formed on either side thereof, a glazing clip engaged within the channel in the outer face of the frame member and projecting forwardly therefrom, a pair of glazing panels each having an outer surface and having an edge disposed within a corresponding one of the glazing recesses, and a cover member which engages the glazing clip, the cover member comprising means for retaining the glazing panels within the glazing recesses. The glazing panel retainer comprises a means for engaging the glazing clip and bearing surfaces which engage a mutually facing marginal portion of the outer surface of each of the glazing panels when the glazing panel retainer is engaged with the glazing clip to retain the glazing panels within the glazing recesses during assembly of the curtain wall construction. The glazing panel retainer is configured to be concealed beneath the cover member such that the glazing panel retainer does not have to be disengaged from the glazing clip prior to the cover member being engaged with the glazing clip.

Thus it is an object of the present invention to provide an improved apparatus and method for erecting glazed panel wall constructions such as curtain walls, storefronts, and the like.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1A:
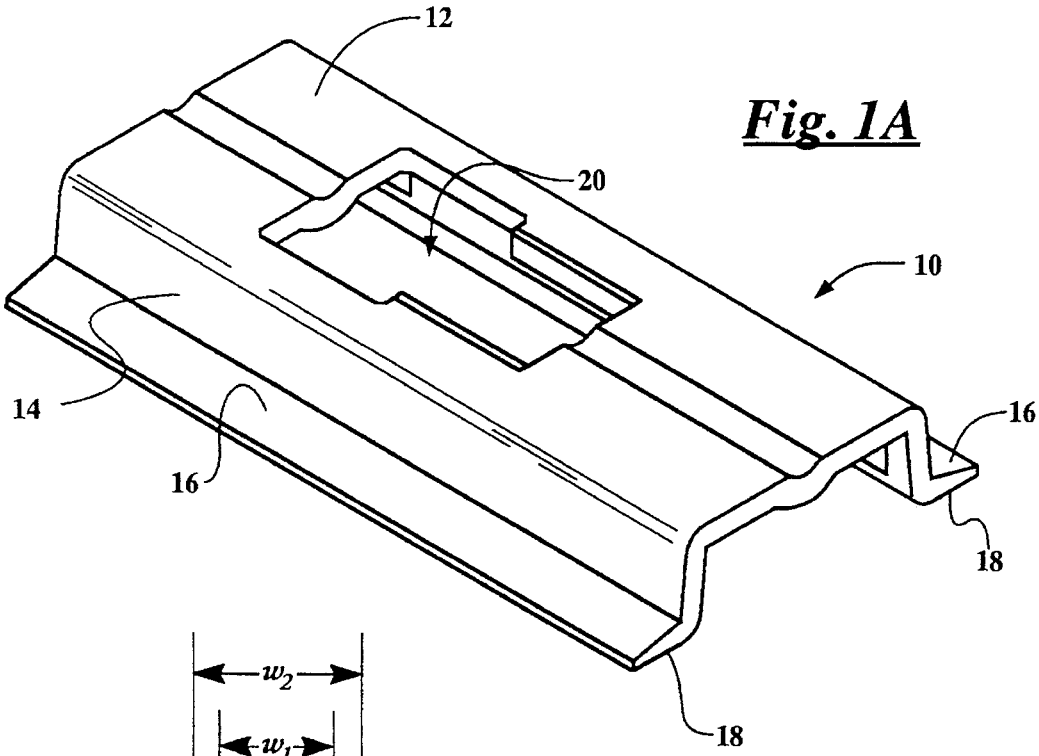
FIG. 1A is a perspective view of a preferred embodiment of a temporary glazing panel retainer according to the present invention.
Figure 1B:
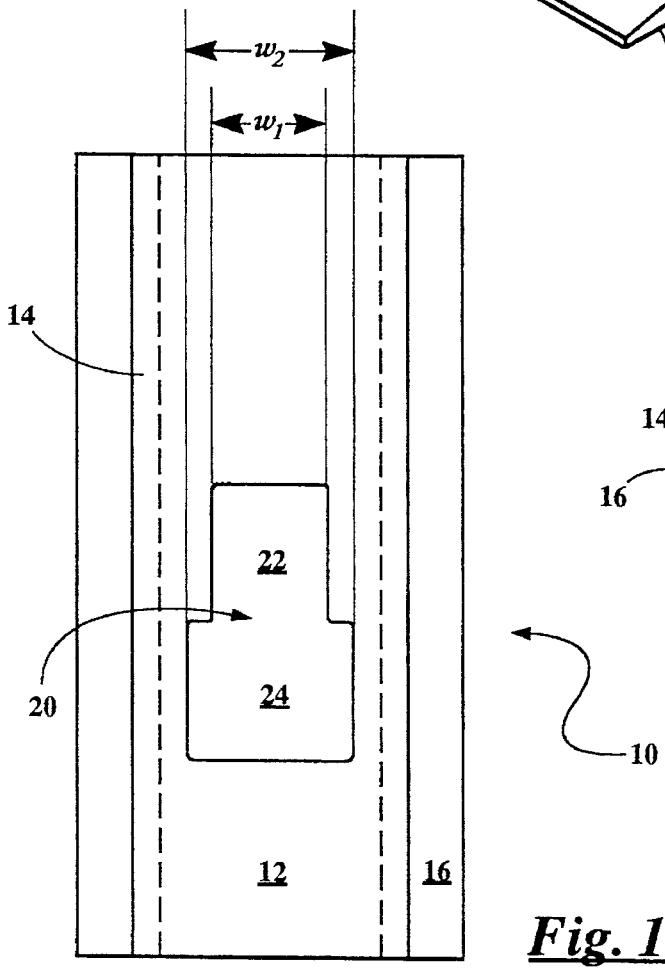
FIG. 1B is a front view of the retainer of FIG. 1A.
Figure 1C:
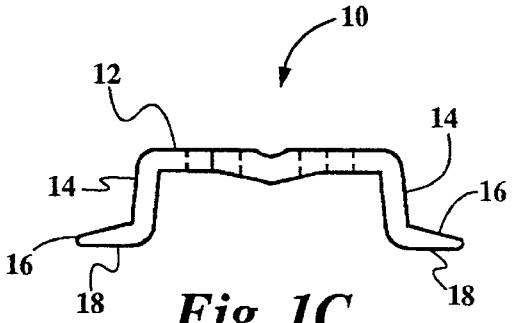
FIG. 1C is an end view of the retainer of FIG. 1A.
Figure 2B:
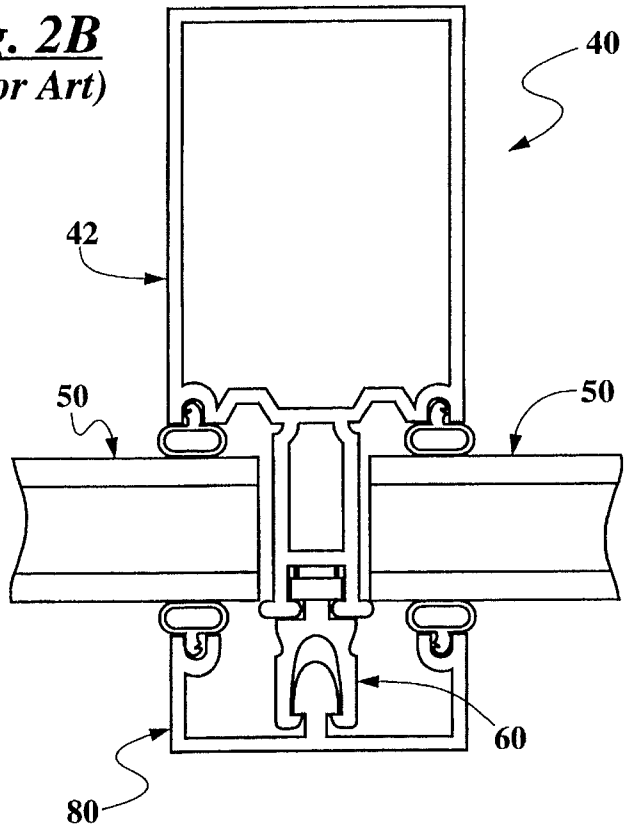
Fig. 2B (Prior Art)
FIG. 2B is a top view showing the curtainwall construction of FIG. 2A assembled.
Figure 2A:
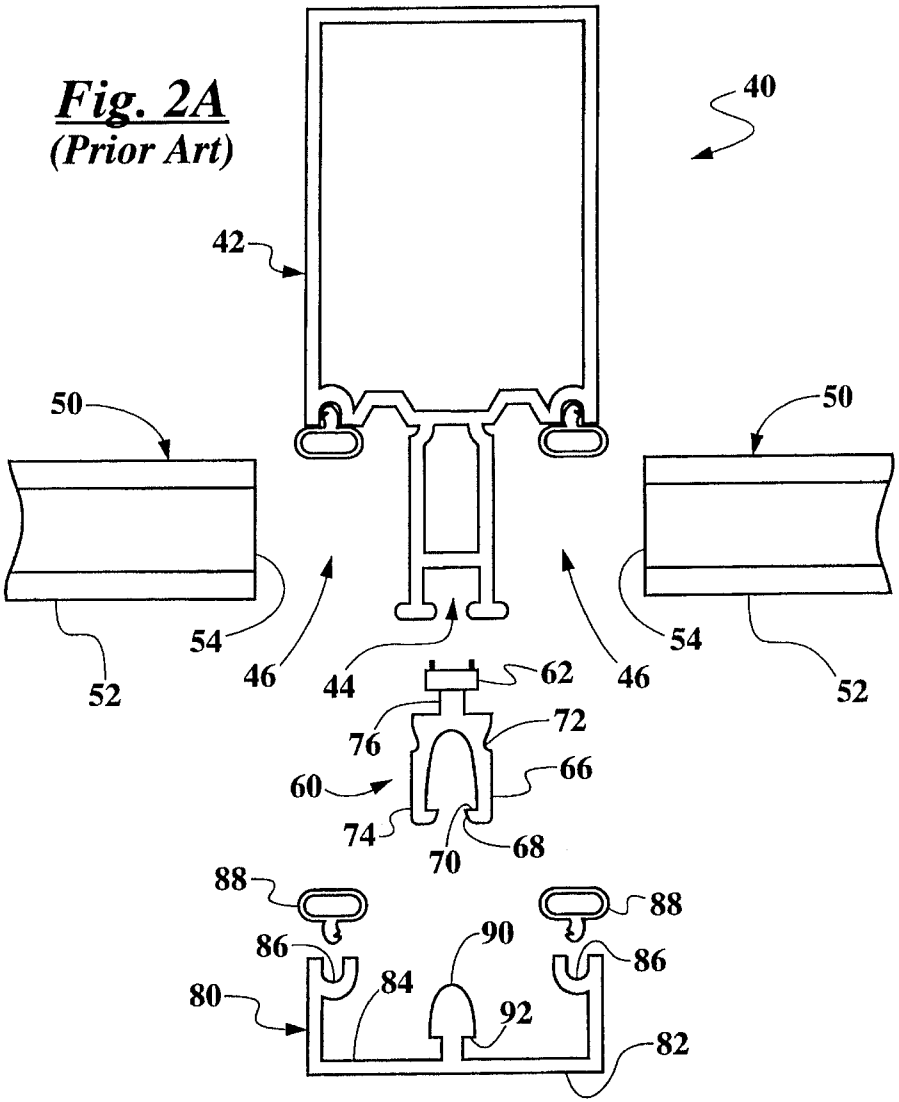
Fig. 2A (Prior Art)
FIG. 2A is an exploded top view of a prior art curtainwall construction of the type with which the retainer of FIGS. 1A–1C is intended to be used.
Figure 3:
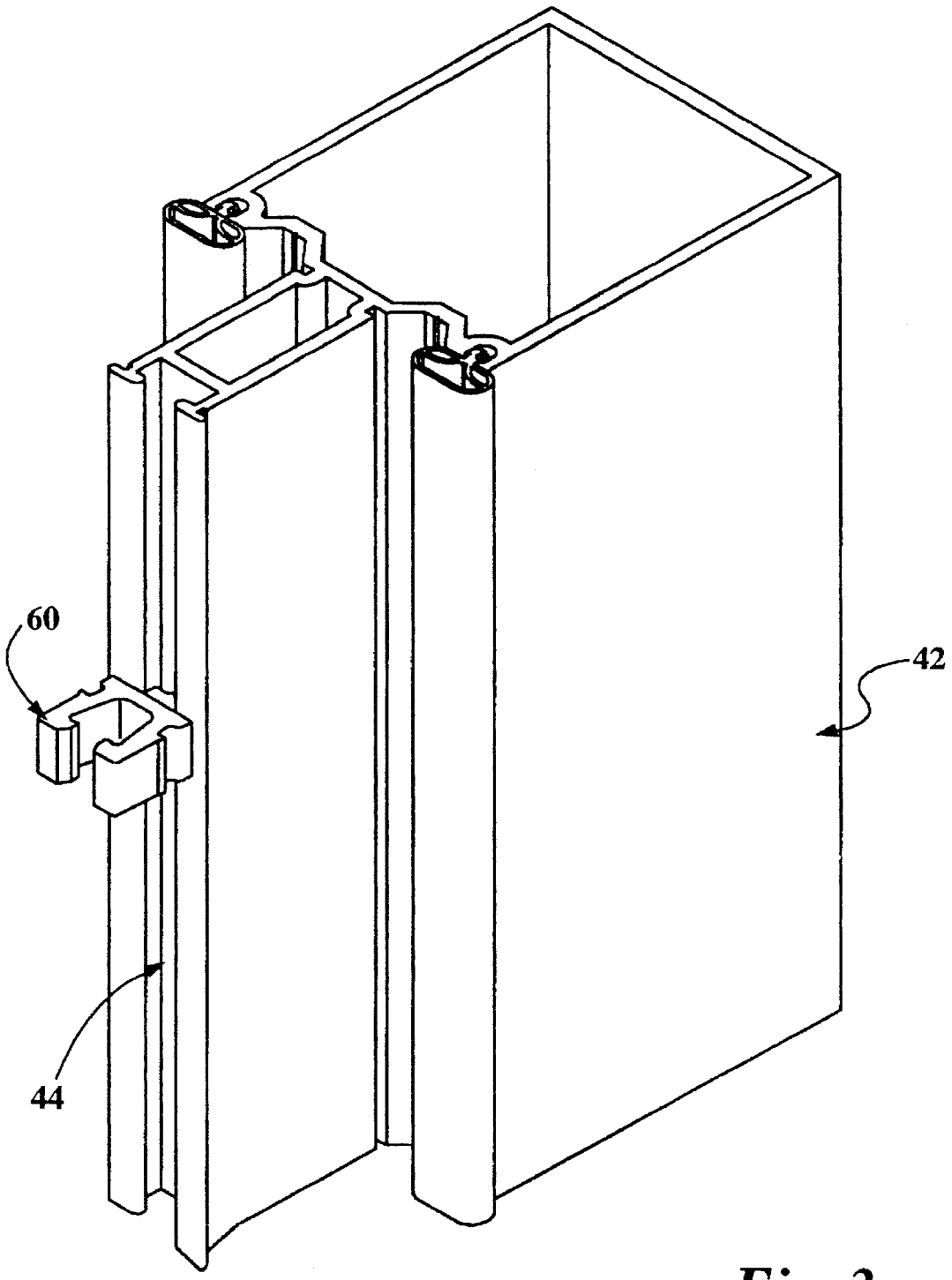
FIGS. 3–7 are perspective views illustrating the assembly of a curtain wall construction using the retainer of FIGS. 1A–1C.

Referring now in more detail to the drawings, in which like numerals indicate like elements throughout the several views, FIGS. 1–3 illustrate a preferred embodiment of a temporary glazing panel retainer 10 according to the present invention. The retainer 10 comprises a front panel 12 and side panels 14 extending rearwardly from opposing lateral edges of the front panel 12. An outwardly turned flange 16 is formed at the rear edge of each side panel 14. The rearward facing surfaces 18 of the flanges 16 comprise bearing surfaces, whose function and purpose will be more fully explained below. A keyhole-shaped opening 20 is formed in the front panel 12 of the retainer 10. The keyhole-shaped opening 20 comprises an upper portion 22 having a width $\omega_1$ and a wider lower portion 24 having a width $\omega_2$.

FIGS. 2A and 2B illustrate a prior art wall construction 40 of the general type with which the glazing panel retainer 10 of the present invention is adapted for use. The wall construction 40 comprises a frame member 42 having a channel 44 formed in its forward edge. Glazing recesses 46 are formed on either side of the frame member 42. A pair of glazing panels 50, each of which comprises an outer surface 52 and a lateral edge 54, are mounted to the frame member 42. The lateral edges 54 of the glazing panels 50 are received within the glazing recesses 46 of the frame member.

A glazing clip 60 has a base 62 formed at its inner end for engaging the channel 44 in the face of the frame member 42. The glazing clip 60 of the disclosed embodiment is disclosed in U.S. Pat. No. 4,750,310, which patent is incorporated herein by reference, and hence the installation and operation of the clip will not be described here in great detail. The glazing clip 60 is formed from a thermally nonconductive material, such as plastic. The outer portion of the clip 60 comprises a pair springable snap legs 66. Downwardly and inwardly beveled lead-ins 68 are formed at the outermost ends of the snap legs 66, the inner edges of the lead-ins defining opposing flanges 70 on the inwardly facing surfaces of the snap legs.

A recess on the lateral surfaces of the snap legs 66 of the glazing clip 60 defines a waist portion 72 which is narrower than the outer portion 74 of the clip. The waist portion 72 of the glazing clip 60 is slightly narrower than the width $\omega_1$ of the upper portion 22 of the keyhole-shaped opening 20 of the retainer 10. The outer portion 74 of the clip 60 is slightly narrower than the width $\omega_2$ of the lower portion 24 of the keyhole-shaped opening 20 of the retainer 10 and slightly wider than the width $\omega_1$ of the upper portion 22 of the keyhole-shaped opening 20. The significance of these relationships will be more fully appreciated when the installation of the retainer 10 is hereinbelow explained.

With further reference to the glazing clip 60, a stem 76 connects the snap legs 66 and the base 62. When the base 62 of the glazing clip 60 is installed within the channel 44 in the face of the frame member 42, the clip projects forwardly from the frame member.

A cover member 80 has an outer surface 82 and a concave inner surface 84. Gasket raceways 86 are formed at the rear edges of the cover member and provide a means by which rearwardly facing gaskets 88 are mounted to the cover member 80. The cover member 80 further comprises a rearwardly projecting flange 90 having shoulders 92 formed thereon. The flange 90 of the cover member 80 is adapted to be inserted between the springable snap legs 66 of the glazing clip 61), the flanges 71) on the inner surface of the snap legs 66 engaging the shoulders 92 formed on the flange 90 of the cover member 80 to couple the cover member to the glazing clip 60.

Assembly of a curtain wall construction utilizing the temporary glazing panel retainer 10 of the present invention is illustrated in FIGS. 3–7. Referring first to FIG. 3, a frame member 42 is erected, and a glazing clip 60 is installed into the channel 44 on the front edge of the frame member. Depending upon the design of the glazing clip and logistics of a particular application, the glazing clip may be installed onto the face of the frame member at the job site after it is erected, or it may have been installed onto the frame member at the factory prior to being shipped to the job site. With the framing member and glazing clip in place, glazing panels are set into place on either side of the frame member.

Figure 4:
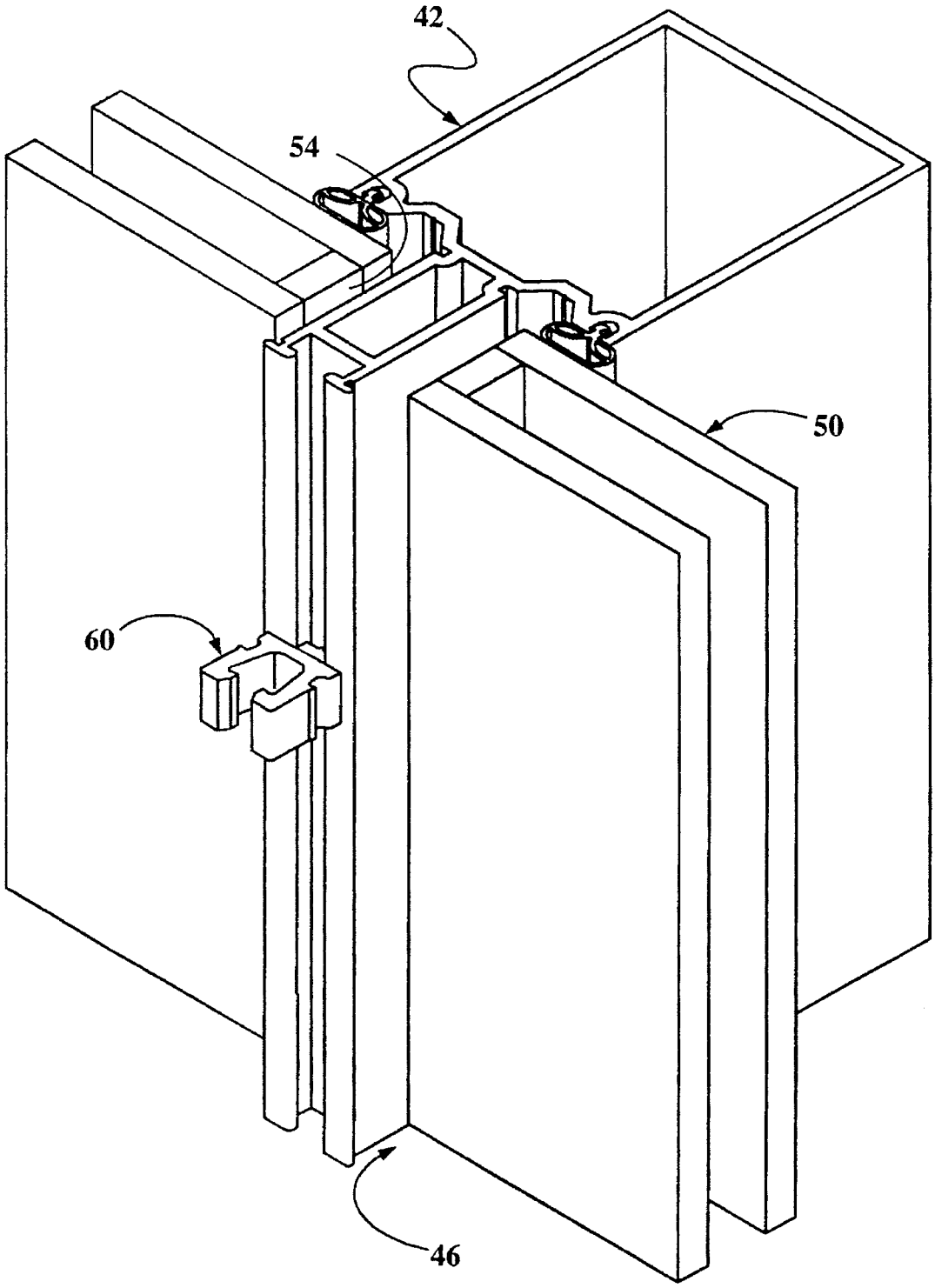

Referring now to FIG. 4, the glass panels 50 are set into place on either side of the frame member 42, the lateral edges 54 of each glass panel being inserted into their corresponding glazing recesses 46.

Figure 5:
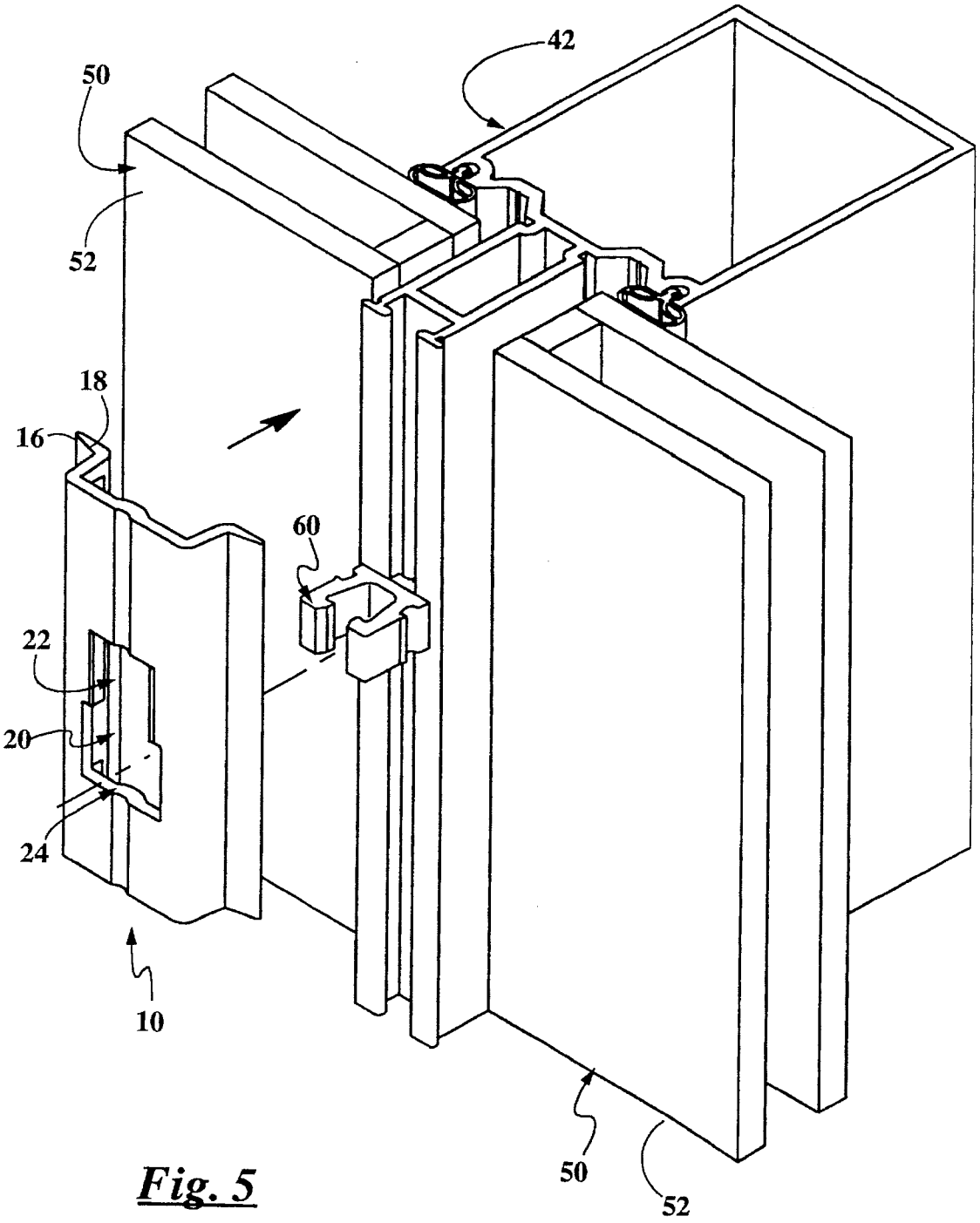
Figure 6:
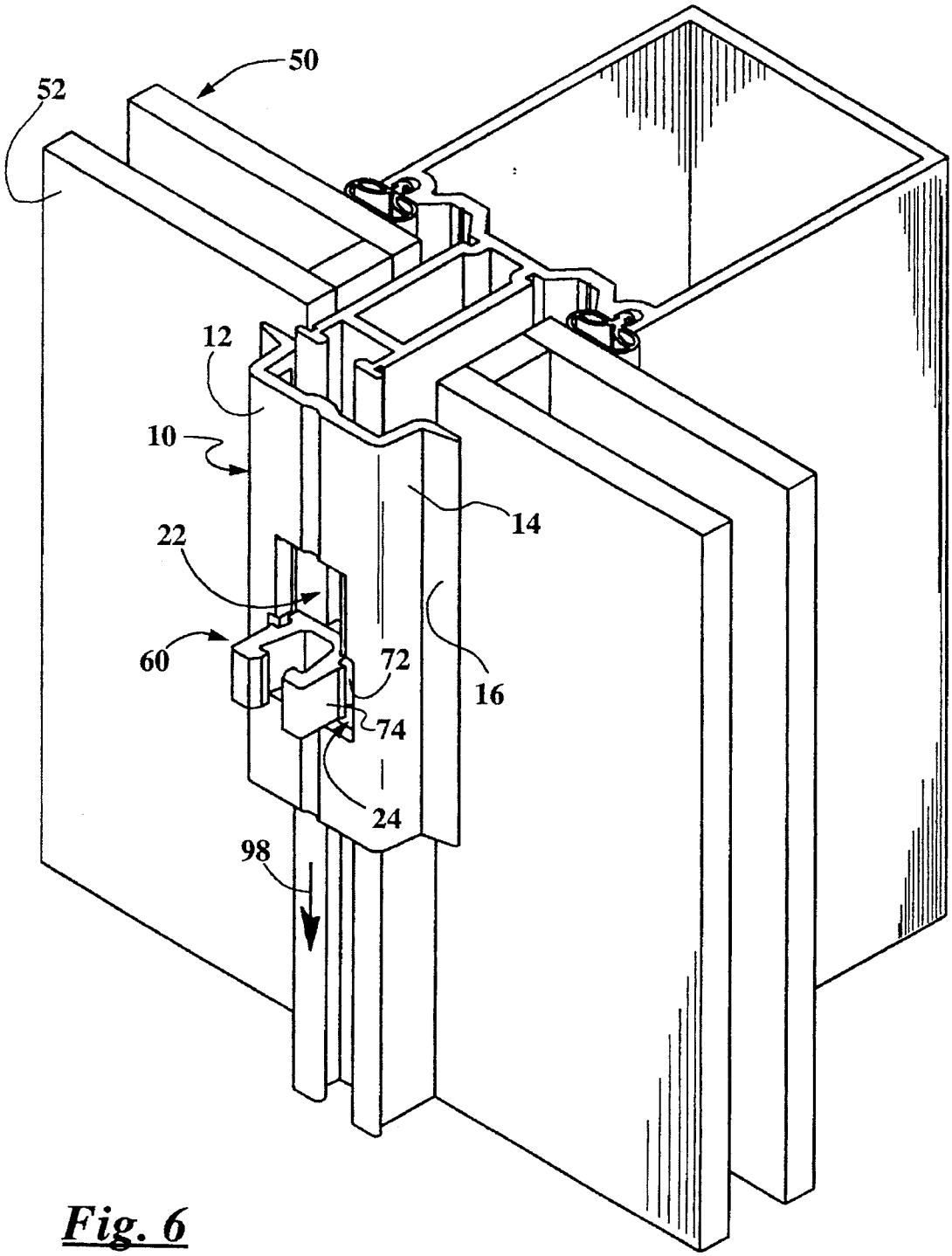

FIGS. 5 and 6 illustrate the installation of the temporary glass retainer 10 to retain the glass panels 50 in place. To install the retainer 10, the retainer is first oriented with the wide portion 24 of the keyhole-shaped aperture 20 below the narrow portion 22. The retainer 10 is then positioned such that the wide lower portion 24 of the keyhole-shaped aperture 20 is aligned with the glazing clip 60, as shown in FIG. 5. The retainer 10 is then inserted over the glazing clip 60 as shown in FIG. 6, the clip being received through the wide lower portion 24 of the keyhole-shaped aperture 20 in the front panel 12 of the retainer, and the retainer is advanced until the bearing surfaces 18 of the flanges 16 abut the margins of the front surfaces 52 of the adjacent glazing panels 50.

With the retainer 10 in the position shown in FIG. 6, the front panel 12 of the retainer is positioned behind the wide upper portion 74 of the clip 60, and the keyhole-shaped aperture 20 is aligned in the same vertical plane as the narrower waist portion 72 of the clip. The retainer 10 is now slid downwardly in the direction indicated by the arrow 98, the narrower upper portion 22 of the keyhole-shaped aperture 20 being advanced down over the narrow waist portion 72 of the glazing clip 60 and behind the outer portion 74 of the clip. Because the narrow upper portion 22 of the keyhole-shaped aperture 20 is narrower than the relatively wide upper section 74 of the glazing clip, the retainer 10 is captured behind the upper section of the glazing clip and is thus held securely in place. In turn, the bearing surfaces 18 of the flanges 16 of the retainer 10 bear against corresponding marginal portions of the front surfaces 52 of the adjacent glazing panels 50, thereby retaining the glazing panels within their respective glazing recesses 46.

Figure 7:
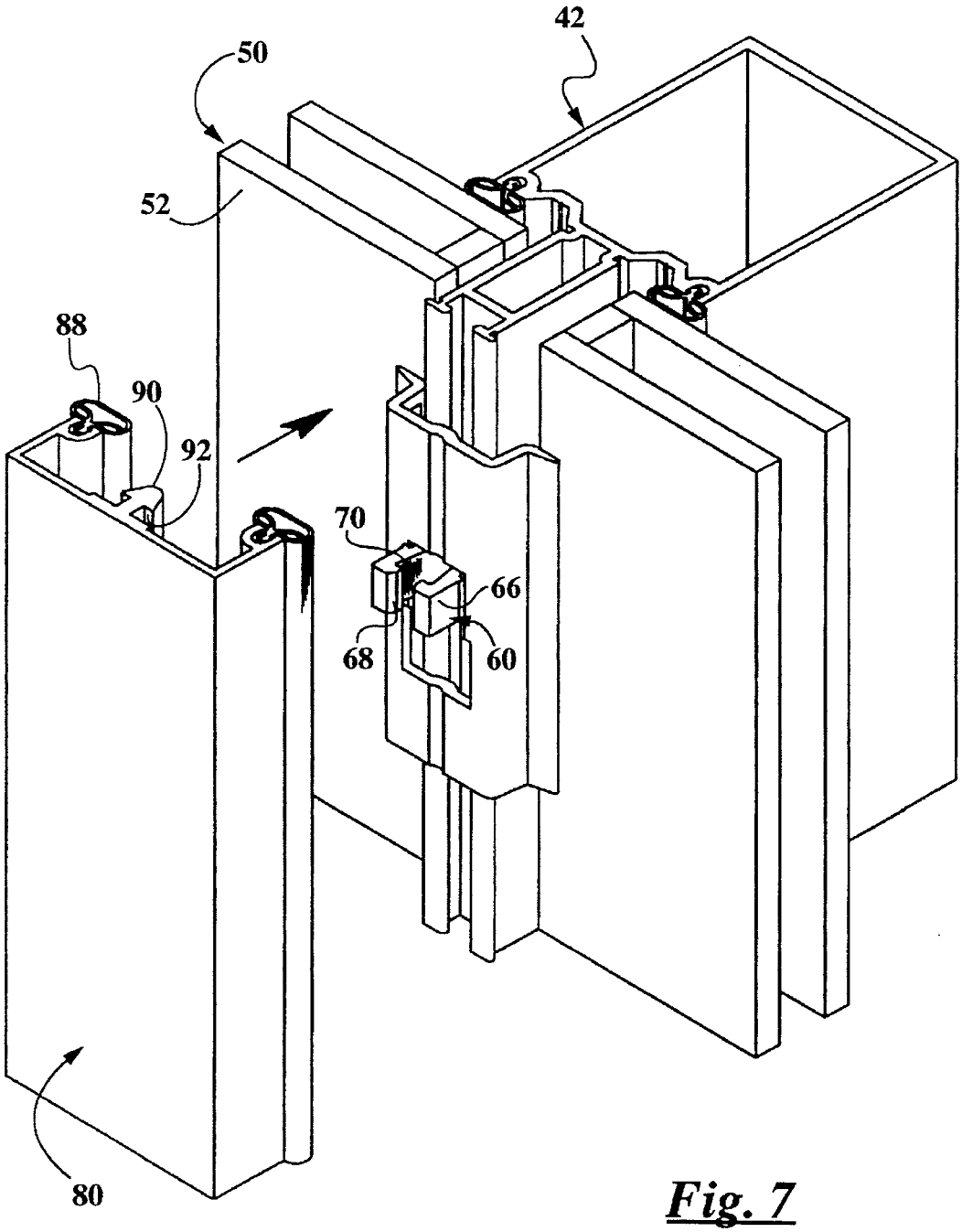
Figure 8:
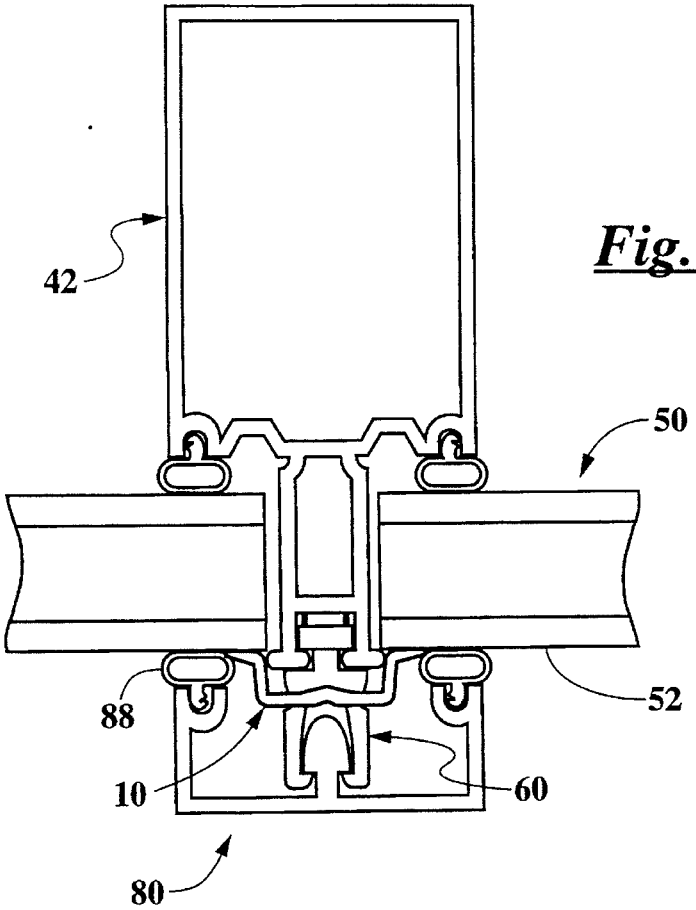
FIG. 8 is a top view of a curtainwall construction assembled according to the procedure depicted in FIGS. 3–7 and employing the retainer of FIGS. 1A–1C.

The final step in the assembly sequence the installation of the snap-on cover member 80, as shown in FIG. 7. The flange 90 of the cover member is aligned between the arms of the glazing clip 60 and advanced until the shoulders 92 of the flange advance past the beveled lead-ins 68 of the outwardly projecting arms 66 of the glazing clip. At this point the arms 66 of the glazing clip 60 snap inwardly to bring the flanges 70 of the glazing clip into engagement with the shoulders 92 of the flange 90 of the cover member 80. This mechanical engagement between the flange 90 of the cover member and the arms 66 of the glazing clip 60 retains the cover member in place. In turn, the glazing gaskets 88 on the outer rear edges of the cover member 80 bear against the outer surface 52 of the respective glazing panels 50. As shown in the assembled top view of FIG. 8, the width of the temporary retainer 10 is sufficiently narrow that the cover member 80 can be installed over the retainer and conceal the retainer from view. Thus the retainer 10 need not be removed before the cover member 80 is installed, thereby eliminating an installation step.

In a typical storefront or curtain wall installation, glazing clips 60 will be mounted to the frame members 42 at approximately 12 inch intervals. However, it is not necessary to fasten temporary retainers 10 to every glazing clip. Rather, it has been found that two retainers 10 spaced along each vertical edge and one retainer 10 spaced along each horizontal edge of each framed opening are sufficient to maintain the glazing panels 50 in place until the cover members 80 can be installed.

Figure 9:
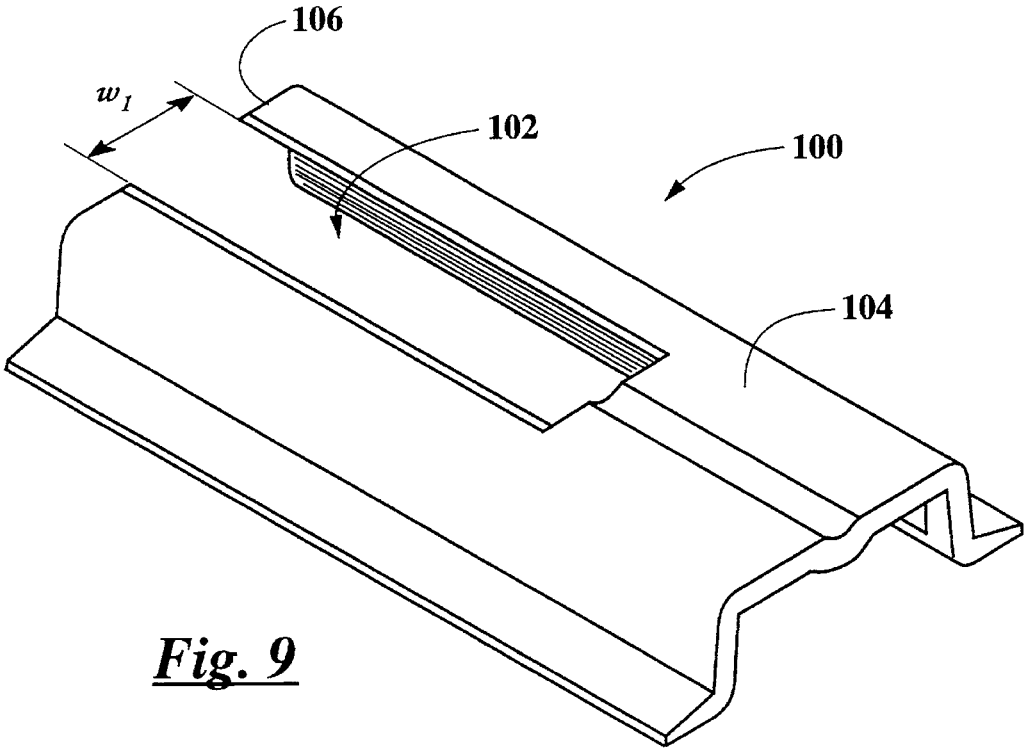
FIG. 9 is a perspective view of an alternate embodiment of a temporary glazing panel retainer according to the present invention.

FIG. 9 is a front view of an alternate embodiment 100 of a temporary glazing panel retainer according to the present invention. The retainer 100 is identical in most respects to the retainer 10 previously described, except that a single narrow slot 102 is formed in the front panel 104 of the retainer, rather than a keyhole-shaped aperture as disclosed in the earlier embodiment. The slot 102 extends all the way to the lower edge 106 of the retainer 100 and has a width $\omega_1$ which is narrower along its entire length than the outer portion 74 of the glazing clip 60 and slightly wider than the waist portion 72 of the glazing clip. The installation of the retainer 100 is also slightly differently from the installation of the retainer 10 previously described. Rather than inserting the retainer 100 over the glazing clip 60 from the front, the retainer 100 is placed above the clip and behind the outer section 74 of the clip and is slid downwardly around the narrow waist portion 72 of the glazing clip. Once installed, the retainer 100 is captured behind the outer section 74 of the glazing clip 60 and retains the glazing panels 50 in place in the same manner as hereinabove described with respect to the retainer 10.

The retainers 10 and 100 of the disclosed embodiment afford significant advantages over the prior art. First, the retainers are configured to be hung on existing glazing clips. Hanging the retainers on the clips is not only significantly faster than driving a screw into the face of the frame member but also obviates the need for parts such as the screws and for mounting tools such as the screwdriver needed for driving the screws. Further, the retainers are configured to be concealed beneath the cover member. Thus, the cover members can be installed without having to remove the retainers, thereby eliminating a step in assembly.

While the retainers 10 and 100 of the disclosed embodiments are especially dimensioned for use with a glazing clip 60 having a waist portion 72, it will be appreciated that the invention is not limited to a retainer configured for use with such a glazing clip having a waist portion and that other clip configurations which afford a wide outer portion and a narrower inner portion can be employed. For example, a retainer could be configured to fit around the stem of a glazing clip and below the main body portion of the clip, rather than having a reduced area formed in the main body portion, and achieve the same results as the disclosed embodiments.

Finally, it will be understood that the preferred embodiment has been disclosed by way of example, and that other modifications may occur to those skilled in the art without departing from the scope and spirit of the appended claims.

What is claimed is:

1. A glazed panel wall construction comprising:

a frame member having a channel formed in its outer face and having glazing recesses formed on either side thereof;

a glazing clip engaged within said channel in said outer face of said frame member and projecting forwardly therefrom;

a pair of glazing panels each having an outer surface and having an edge disposed within a corresponding one of said glazing recesses;

a glazing panel retainer which engages said glazing clip and which has bearing surfaces which engage a mutually facing marginal portion of said outer surface of each of said glazing panels to retain said glazing panels within said glazing recesses during assembly of said curtain wall construction; and a cover member which engages said glazing clip, said cover member comprising means for retaining said glazing panels within said glazing recesses, and said glazing panel retainer being concealed beneath said cover member such that said glazing panel retainer does not have to be disengaged from said glazing clip prior to said cover member being engaged with said glazing clip.

2. The wall construction of claim 1, wherein said glazing clip comprises an outer portion and an inner portion narrower than said outer portion, and wherein said glazing panel retainer comprises means defining a slot therein, said slot having a width which is wider than said inner portion of said glazing clip but narrower than said outer portion of said glazing clip, whereby said glazing panel retainer engages said glazing clip by said slot being advanced over said inner portion of said glazing clip and behind said outer portion of said glazing clip.

3. The wall construction of claim 2, wherein said slot comprises a first slot, and wherein said glazing panel retainer further comprises a second slot in communication with said first slot, said second slot having a width which is greater than said outer portion of said glazing clip, whereby said glazing panel retainer engages said glazing clip by said retainer being moved toward said frame member such that said second slot advances over said outer portion of said glazing clip and then said retainer being moved in a vertical plane such that said first slot advances over said inner portion of said glazing clip and behind said outer portion of said glazing clip.

4. A method for erecting a glazed panel wall construction comprising the steps of:

erecting a frame member having a channel formed in its outer face and having glazing recesses formed on either side thereof;

engaging a glazing clip within said channel in said outer face of said frame member so as to project forwardly therefrom;

positioning a pair of glazing panels with respect to said frame member such that each of said pair of glazing panels has an edge disposed within a corresponding one of said glazing recesses;

engaging a glazing panel retainer with said glazing clip such that bearing surfaces of said glazing panel retainer engage a mutually facing marginal portion of an outer surface of each of said glazing panels to retain said glazing panels within said glazing recesses during assembly of said curtain wall construction; and without disengaging said glazing panel retainer from said glazing clip, assembling a cover member onto said glazing clip so as to retain said glazing panels within said glazing recesses, said glazing panel retainer being concealed beneath said cover member.

5. The method of claim 4, wherein said step of engaging a glazing panel retainer with said glazing clip comprises the step of slidably engaging said glazing panel retainer with said glazing clip.

* * * * *